United States Patent [19]

Liang

[11] Patent Number: 4,661,376

[45] Date of Patent: Apr. 28, 1987

[54] METHOD OF PRODUCING ELECTRICALLY CONDUCTIVE FIBERS

[76] Inventor: Paul M. Liang, 4216 Hickory Rd., Apt. 3D, Mishawaka, Ind. 46544

[21] Appl. No.: 813,987

[22] Filed: Dec. 27, 1985

[51] Int. Cl.[4] ..... B05D 5/12

[52] U.S. Cl. ..... 427/126.1; 427/430.1; 428/379; 428/389; 428/922

[58] Field of Search ..... 428/379, 389, 922; 427/126.1, 430.1; 252/518

[56] References Cited

U.S. PATENT DOCUMENTS

| | | | |
|---|---|---|---|
| 2,146,594 | 2/1939 | Savage et al. | 428/389 |
| 3,940,533 | 2/1976 | Arsac | 428/389 X |
| 4,167,805 | 9/1979 | Castel | 427/126.1 |
| 4,309,477 | 1/1982 | Pezzoli | 429/379 |
| 4,330,347 | 5/1982 | Hirayama et al. | 428/389 X |
| 4,336,028 | 6/1982 | Tomibe et al. | 427/126.1 |
| 4,364,739 | 12/1982 | Tomibe et al. | 427/126.1 |
| 4,374,893 | 2/1983 | Arsac et al. | 427/430.1 |

FOREIGN PATENT DOCUMENTS

| | | | |
|---|---|---|---|
| 619542 | 7/1978 | U.S.S.R. | 427/126.1 |

*Primary Examiner*—Shrive P. Beck

*Attorney, Agent, or Firm*—Thomas J. Dodd

[57] ABSTRACT

A method of producing electrically conductive fibers by treating acrylic fibers, acrylic-series fibers, or nylons in a heated bath which contains copper (II) sulfide and an acid. The copper (II) sulfide is adsorbed into the fibers in the presence of the heated acid to improve electrical conductivity of the fibers.

10 Claims, No Drawings

METHOD OF PRODUCING ELECTRICALLY CONDUCTIVE FIBERS

BACKGROUND OF THE INVENTION

This invention relates to a method of producing electrically conductive materials, and has special but not limited application to a method of producing electrically conductive acrylic or acrylic-series fibers, and nylons.

Static electricity is a recognized problem in several art fields, namely electronics, plastics, processing, graphic arts and photo processing. A number of static control products have been introduced which help prevent static discharge from electrostatic sensitive devices. Electrically conductive fibers play an important role in these static control products. U.S. Pat. No. 4,336,028 discloses a method of producing electrically conductive acrylic fibers by reduction of divalent copper ions into monovalent copper ions, then reacting with a sulfur-containing compound to form copper (I) sulfide or copper (II) sulfide. This process required lengthy (1–2 hours) periods of exposure of the fiber to the bath, an undesirable situation.

Other recognized problems have occurred in the use of computer terminals and other video display screens. For instance, the surface of a cathode ray tube (CRT) in computers serves to reflect surrounding glare, but also generates an adjacent static electricity field. The glare problem has been overcome by the addition of a glare filter which is constructed of fine black filaments woven into a nylon screen as disclosed in U.S. Pat. No. 4,253,737. U.S. Pat. No. 4,468,702 discloses a screen which suppresses static electricity along the CRT surface, but only a portion of the yarns are electrically conductive.

SUMMARY OF THE INVENTION

The method of producing electrically conductive fibers of this invention involves the treatment of the fibers in a one-bath solution of copper (II) sulfide and a strong acid. The fibers produced by the method possess excellent electrical properties and are efficient in preventing discharge of static electricity. By forming the bath with a strong acid, exposure time of the fibers is reduced.

The method is also effective in the production of electrically conductive nylon screens. All yarns in the screens produced by the method are electrically conductive, and effectively suppress the static field which surrounds the CRT surface and reduces electromagnetic radiation which emanates from the CRT circuitry.

Accordingly, it is an object of this invention to provide for a novel method of producing electrically conductive fibers and screens.

Another object of this invention is to provide for a method of producing conductive nylon screens, which screens effectively reduce emanation of static electricity from electrical devices.

Still another object of this invention is to provide for a method of producing conductive fibers, which fibers exhibit superior electrical properties.

Other objects of this invention will become apparent upon a reading of the following description.

DESCRIPTION OF THE PREFERRED EMBODIMENT

The preferred method described herein is not intended to be exhaustive or to limit the method to the precise steps or compounds disclosed. It is chosen and described to explain the principles of the method, and its application and practical use whereby others skilled in the art may practice the method.

According to the present method, the acrylic fibers or nylons are treated in a heated bath which contains copper (II) sulfide (CuS) and an acid. CuS is commercially available and the preferred acid is a strong inorganic acid such as hydrochloric acid (HCl) and others. Since high concentrations of acid tend to damage the fibers, the acid is diluted prior to heating and fiber introduction. The preferred concentration of Hcl is 3N–6N for treating acrylic fibers and 1N–2.5N for nylons. Immediately after removal of the fibers from the bath they are washed with water to remove any residual acid from the fibers.

The preferred method involves the following steps. Dilute acid is added to a quantity of CuS and heated to between 50°–100° C. depending upon the type of fibers to be treated, concentration of the acid and CuS, and the intended time of fiber treatment. Stirring takes place at all times within the bath and is preferably accomplished by a conventional magnetic stirrer. When the acid-CuS solution is at the desired temperature for a predetermined time (usually 1–2 hours to allow complete dissolution of the CuS in the acid), the fibers are added to the bath. After a predetermined time, measured by accounting for bath temperature, acid concentration, and CuS concentration, the fibers are removed and washed several times with water or with a buffer or alkaline solution. Water is constantly replaced to prevent acid buildup during washing.

Altogether, there are five factors which affect the results of the method: solution temperature, acid concentration, bath preheat time, treatment time and CuS concentration. More specifically, preheat time and treatment time are influenced by temperature and concentration of the reagents. For instance, the preferred time of preheat is 2 hours, but would be shortened if the temperature was raised or the CuS concentration was lowered. Treatment time is determined in the same fashion, with the exception that if the CuS concentration is lowered, treatment time is increased.

Finally, it is known that use of strong acids enhances the quantity of CuS adsorbed by the fibers, which improves the electrical conductivity of the fibers. However, the recommended optimum treatment time should not be exceeded because the quantity of CuS adsorbed will eventually decrease due to the dissolving property of the heated strong acid. The method will be best understood by referring to the following preferred modes and accompanying examples.

A. ACRYLIC FIBERS

To obtain optimum results in acrylic fibers 13–15% (weight-to-volume ratio) of CuS is added to a bath of 6N HCl. The bath is heated to between 88°–92° C. for two hours with constant stirring. Under these conditions, the preferred fiber treatment time is from 10 to 25 minutes depending upon the exact concentration of CuS. The fiber is washed with water immediately after treatment in the bath, with the solution being repeatedly replaced during each washing.

B. NYLONS

To obtain optimum results in nylons, 5% of CuS is added to 2N HCl (weight-to-volume ratio) and the mixture heated to 50°-70° C. for about two hours with constant stirring. The optimum treatment time under these conditions is 50 minutes and the nylons rinsed with a buffer solution or a dilute alkaline solution (0.5-2M NaOH) prior to washing with water.

The following examples are indicative of the method and results obtained:

EXAMPLE 1

15.0 grams of crystalline CuS was added to 100 ml. of 6N HCl (Fisher, reagent grade). A magnetic stirrer was placed in the bath and activated. The bath temperature was raised to 90° C. and was heated at this temperature for 2 hours. 3.9 grams of acrylic fiber, 2.5 inches long by 1.5 inches wide, supplied by SIGUMA INDUSTRIAL CO., LTD., Taiwan, R.O.C. were immersed in the heated bath for 10 minutes and then removed. The treated fibers were washed with water as described above. The fiber thus obtained had a green color and an electrical resistance of 26 to 80 ohms. The amount of CuS adsorbed onto the fiber was 12.1% in relation to the starting weight of the fiber.

EXAMPLE 2

5.0 grams of crystalline CuS was added to 100 ml. of 2N HCl. A magnetic stirrer was placed in the bath and activated. The bath temperature was raised to 65° C. and was heated at this temperature for 2 hours. 0.41 grams of a microwoven nylon screen having fibers in the range of 0.001 to 0.003 inches thick was cut into 12 pieces of a size 1.5 inches by 1.0 inches, and immersed in the bath for 50 minutes and then removed. The treated screen was then washed with 2M NaOH solution. The screen thus obtained was of olive green color and had an electrical resistance of 1200 ohms. The amount of CuS adsorbed onto the fiber was 4.6% in relation to the starting weight of the material.

EXAMPLE 3

5.0 grams of crystalline CuS was added and 1.5 g. of carbon black powder (Fisher, reagent) was added to 100 ml of 2N HCl. A magnetic stirrer was placed in the bath and activated. The bath temperature was raised to 65° C. and was heated at this temperature for two hours. 0.41 grams of a microwoven nylon screen having fibers in the range of 0.001-0.003 inches thick was cut into 12 pieces of a size 1.5 inches by 1.0 inches, and immersed in the bath for 10 minutes and then removed. The treated screen was then washed with a buffer solution. The screen thus obtained was of black color and had an electrical resistance of 200 ohms. The amount of CuS adsorbed onto the fiber was 7.1% in relation to the starting weight of the material.

It is understood that the invention is not limited to the above-given details, but may be modified within the scope of the appended claims.

I claim:

1. A method of producing electrically conducting fibers comprising the steps of:

(a) preparing a single bath containing a solution of a divalent metal sulfide and an acid; and (b) heat said bath; and (c) immersing said fibers in said bath to effect adsorption of said divalent metal sulfide onto said fibers.

2. The method of claim 1 and a step (d) of removing said fibers from said solution then washing said fibers with water.

3. The method of claim 1 wherein step (a) includes preparing said solution by dissolving copper (II) sulfide in said acid.

4. The method of claim 3 wherein said acid is a strong inorganic acid.

5. The method of claim 4 wherein said acid is hydrochloric acid.

6. The method of claim 4 wherein said acid is diluted to between 1N-6N prior to immersion of said fibers.

7. The method of claim 5 wherein said fibers are acrylic or modacrylic fibers.

8. The method of claim 5 wherein said fibers are interwoven into a nylon screen.

9. The method of claim 5 wherein step (b) includes heating said solution to between 50°-100° C. for 1-2 hours prior to immersion of said fibers.

10. The method of claim 8 wherein step (a) includes adding carbon black powder to said solution at 30% weight to weight ratio with said copper (II) sulfide.

* * * * *